US010301895B2

(12) United States Patent
Nguyen

(10) Patent No.: US 10,301,895 B2
(45) Date of Patent: May 28, 2019

(54) ONE-TRIP HYDRAULIC TOOL AND HANGER

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 256 days.

(21) Appl. No.: 15/289,959

(22) Filed: Oct. 10, 2016

(65) Prior Publication Data

US 2018/0100364 A1 Apr. 12, 2018

(51) Int. Cl.
*E21B 23/01* (2006.01)
*E21B 23/04* (2006.01)
*E21B 33/04* (2006.01)

(52) U.S. Cl.
CPC ..... *E21B 23/01* (2013.01); *E21B 23/04* (2013.01); *E21B 33/04* (2013.01)

(58) Field of Classification Search
CPC ..... E21B 23/01; E21B 23/04; E21B 33/04
See application file for complete search history.

(56) References Cited

U.S. PATENT DOCUMENTS

2004/0251031 A1 12/2004 Reimert
2005/0133216 A1* 6/2005 Bartlett ..... E21B 23/04 166/66.4
2014/0166298 A1* 6/2014 Fenwick ..... E21B 23/00 166/360
2016/0010404 A1 1/2016 Nguyen et al.

FOREIGN PATENT DOCUMENTS

WO 2010088037 A2 8/2010
WO 2012060909 A1 5/2012
WO 2014038956 A1 3/2014
WO 2016018605 A2 2/2016

OTHER PUBLICATIONS

PCT Search Report and Written Opinion for PCT/US2017/055981, dated Dec. 21, 2017; 11 pgs.

* cited by examiner

*Primary Examiner* — Caroline N Butcher
(74) *Attorney, Agent, or Firm* — Fletcher Yoder, P.C.

(57) ABSTRACT

A system includes a hanger running tool, which has a tool body, a first piston configured to move a first lock member between first locked and unlocked positions between the tool body and a hanger, and a second piston configured to move a second lock member between second locked and unlocked positions between the hanger and a tubing.

20 Claims, 8 Drawing Sheets

ONE-TRIP HYDRAULIC TOOL AND HANGER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations. Hangers (e.g., tubing hangers or casing hangers) may be used to support sections or strings of casing or tubing within a wellhead assembly. Hangers are typically installed by a tool (e.g., a hanger running tool) in multiple trips by the tool. Unfortunately, each trip by the tool increases the time and costs associated with installation of the hanger.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed embodiments include a hydraulically actuated hanger and a hanger running tool capable of installing the hanger within a wellhead assembly in a single trip. Installing the hanger in a single trip, using hydraulics, reduces the time and cost associated setting up and operating a mineral extraction system. Specifically, in the disclosed embodiments, a plurality of pistons are sequentially actuated via a pressurized fluid to actuate a first lock ring to secure the running tool to the hanger, and also to actuate a second lock ring to secure the hanger to the casing spool. The piston drive actuation of the lock rings may be achieved using a common fluid passage. Subsequently, the running tool may be released from the hanger by actuating one of the pistons via a pressurized fluid to release the lock ring between the running tool and the hanger, while the lock ring between the hanger and the casing spool remains in place. The running tool may then be retrieved from the wellhead assembly.

Figure 1:
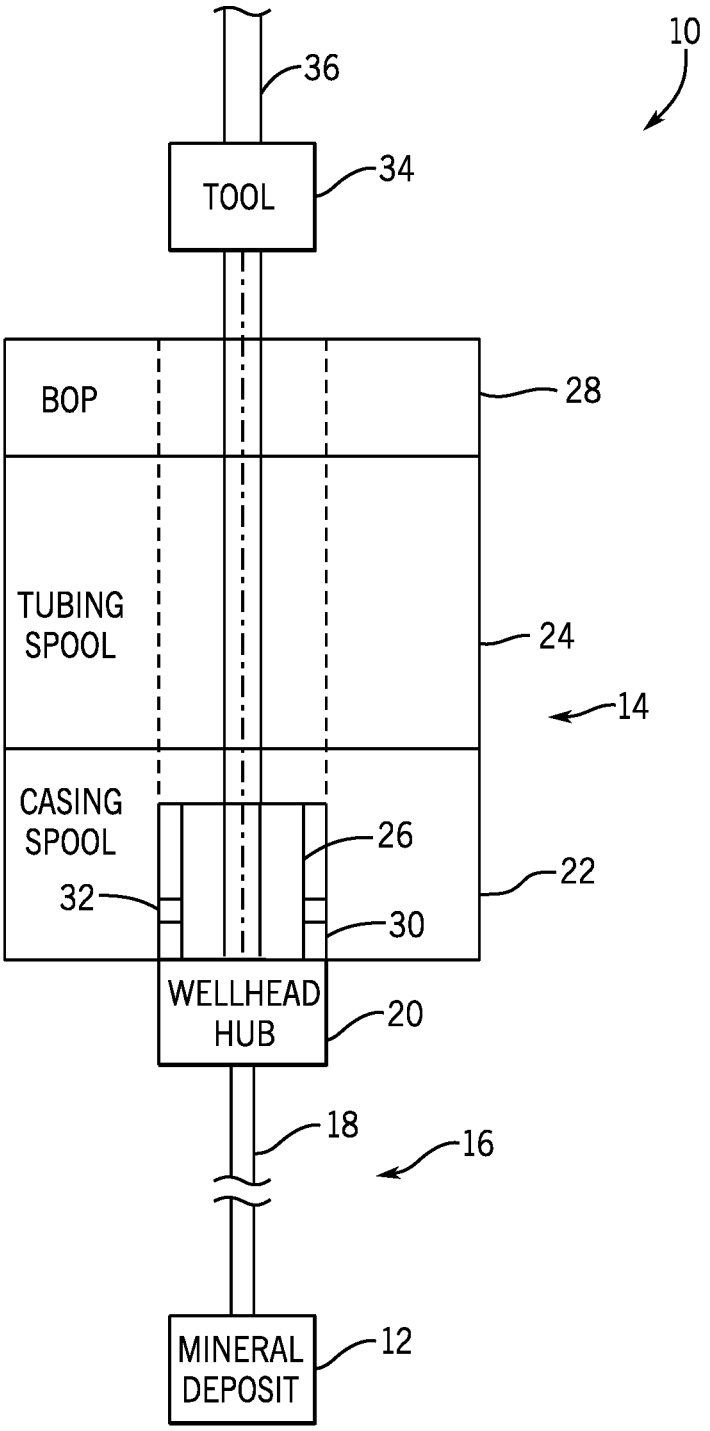
FIG. 1 is a schematic of an embodiment of a mineral extraction system.

FIG. 1 is a schematic of an exemplary mineral extraction system 10 configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the reservoir 12 to a wellhead hub 20 located at or near the surface.

The illustrated wellhead hub 20, which may be a large diameter hub, acts as an early junction between the well 16 and the equipment located above the well. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 for installation and removal of various components (e.g., hangers, shoulders, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as emplacing tools or components within the casing spool 22. To emplace the components, a shoulder 32 provides a temporary or permanent landing surface that can support pieces of equipment (e.g., hangers). For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) to the well 16, the wellhead 14, and the like. The hanger 26 may be installed on the shoulder 32 and used to support sections of casing or tubing within the wellhead assembly 14.

Figure 2:
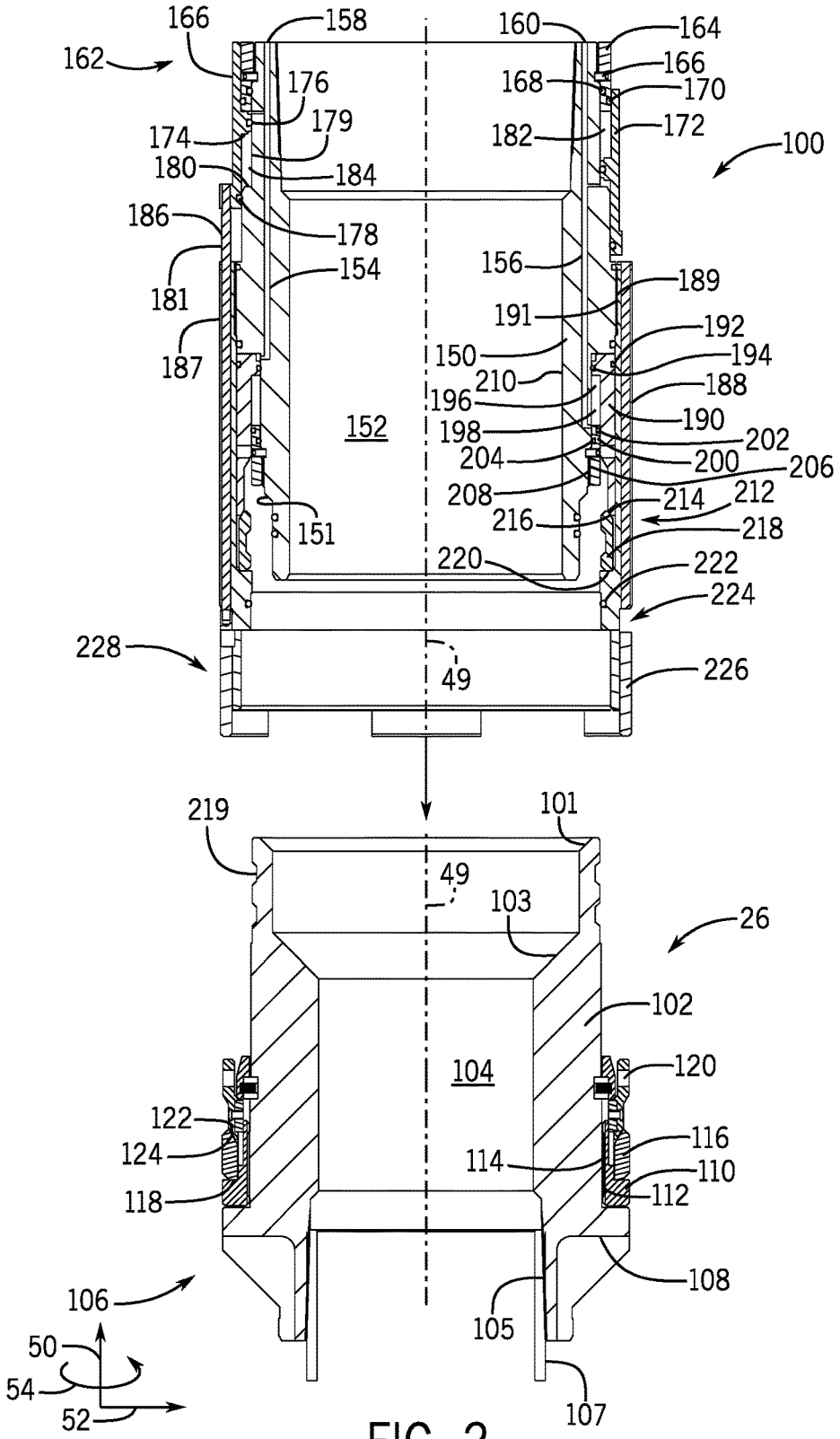
FIG. 2 is a side, section view of a hanger running tool being coupled to a hanger for installation in a wellhead assembly.

FIG. 2 is a side, section view of a hanger running tool 100 being coupled to a hanger 26 for installation in a wellhead assembly 14. The hanger running tool 100 is coupled to the hanger 26 before the tool 100 is inserted into the wellhead assembly 14. For example, the hanger running tool 100 may be coupled to the hanger 26 on the rig floor. For reference, a coordinate system is shown comprising an axial direction or axis 50, a radial direction or axis 52, and a circumferential direction or axis 54 relative to a central axis 49.

The hanger 26 includes a generally annular body 102, which defines a bore 104, an upper tapered annular shoulder 103, and a lower mounting interface 105 (e.g., threaded interface), which may be used to hang a tubular 107. Proximate an axial end 106 (e.g., downhole end) of the body 102 is a lip 108 (e.g., a radially protruding annular flange, shoulder, or surface). Disposed about the body 102 is an annular preload ring 110. The preload ring 110 has an interior threaded surface 112 that engages with an exterior threaded surface 114 of the body 102 to hold the preload ring 110 in place relative to the body 102. A lock ring 116 may be disposed about the body 102 and the preload ring 110, and may rest upon a lip 118 (e.g., a radially protruding annular lip or annular surface) of the preload ring 110. A push ring 120 may be disposed about the body 102. The push ring 120 may have an inward tapered exterior surface 122 (e.g., energizing taper portion) that interfaces with an inward tapered interior surface 124 (e.g., energizing taper portion) of the lock ring 116 such that when the push ring 120 moves in the axial direction 50 toward the lock ring 116, the lock ring 116 expands radially outward. Correspondingly, when the push ring 120 moves in the axial direction 50 away from the lock ring 116, the lock ring 116 may radially contract.

The hanger running tool 100 includes an annular body 150, which defines a bore 152. The body 150 also defines first and second fluid passages 154, 156, which may be pressurized by a pressurized fluid (e.g., hydraulically, pneumatically, etc.) in order to actuate various components of the hanger running tool 100. The first and second fluid passages 154, 156 may be in fluid communication with first and second pressure ports 158, 160 disposed at a first axial end 162 of the hanger running tool 100. Fluid (e.g., air, hydraulic fluid, oil, water, etc.) in the passages 154, 156 may be pressurized from one or more pressurized fluid sources (e.g., fluid pumps, tanks, accumulators, etc.) through applying pressure via the first and second pressure ports 158, 160.

An annular upper retainer ring 164 may be disposed about the body 150 at or toward the first axial end 162 of the hanger running tool 100. The upper retainer ring 164 may be coupled to the body 150, and/or the axial position of the upper retainer ring 164 relative to the body 150 may be set via one or more set screws 166. The upper retainer ring 164 may include one or more interior seals 168 (e.g., o-ring), which form a seal between the upper retainer ring 164 and the body 150. The upper retainer ring 164 also includes one or more exterior seals 170 (e.g., o-ring), which form a seal between the upper retainer ring 164 and an outer piston 172.

The outer piston 172 may be generally annular in shape (e.g., annular piston) and disposed about the body 150 and the upper retainer ring 164. The outer piston 172 includes an annular protrusion 174 that protrudes radially inward, toward the body 150. The annular protrusion 174 of the outer piston 172 includes one or more first interior seals 176 (e.g., o-ring) that form a seal with the body 150. The outer piston 172 includes one or more second interior seals 178 (e.g., o-ring), which also form a seal with the body 150. The body 150 includes a shoulder 180 (e.g., annular shoulder or surface) facing in the axial upward direction 50, resulting from a change in the outside diameter of the body 150 from a first annular portion 179 (e.g., smaller diameter portion) to a second annular portion 181 (e.g., larger diameter portion). The first interior seal 176 and the second interior seal 178 are disposed on either side of the annular surface 180. The outer piston 172 may be configured to move in the axial direction 50 back and forth along the body 150 increasing and decreasing a first volume 182 (e.g., annular volume or piston-cylinder chamber) disposed between the exterior seal 170 of the upper retainer ring 164 and the first interior seal 176, and a second volume 184 (e.g., annular volume or piston-cylinder chamber) disposed between the first interior seal 176 and the second interior seal 178. It should be noted that the left side of FIG. 2 (e.g., left of axis 49) shows the outer piston 172 in a raised position, and that the right side of FIG. 2 (e.g., right of axis 49) shows the outer piston 172 in a lowered position.

The outer piston 172 may be coupled to one or more push members 186 (e.g., linkages, rods, sleeves, or elongated structures), which may be used to actuate the push ring 120 and lock ring 116 of the hanger 26. In certain embodiments, the push members 186 include one or more push rods spaced circumferentially about the central axis 49. As discussed in further detail below, an outer sleeve 188 (e.g., annular sleeve) may be disposed about the push members 186. In some embodiments, the push members 186 may extend axially through axial slots or passages 187 in the outer sleeve 188. In the illustrated embodiment, the outer sleeve 188 includes a threaded interior surface 189 that interface with a threaded exterior surface 191 of the body 150 to hold the outer sleeve 188 in place.

An inner piston 190 (e.g., annular piston) may be disposed about the body 150, but radially interior of the outer sleeve 188. The inner piston 190 includes one or more outer seals 192 (e.g., o-ring), which form a seal between the inner piston 190 and the outer sleeve 188, and one or more inner seals 194 (e.g., o-ring), which form a seal between the inner piston 190 and the body 150. The inner piston 190 also includes a radially interior annular recess 196 below the inner seal 194, forming a third volume 198 (e.g., annular volume or piston-cylinder chamber), which is in fluid communication with the second pressure port 160.

A sealing ring 200 may be disposed radially interior of the inner piston 190, within the recess 196. The sealing ring 200 may have one or more exterior seals 202 (e.g., o-rings), which forms a seal between the sealing ring 200 and the inner piston 190, and one or more interior seals 204 (e.g., o-ring), which form a seal between the sealing ring 200 and the body 150. The sealing ring 200 has an interior threaded surface 206, which interfaces with a threaded exterior surface 208 of the body 150 to hold the sealing ring 200 in place. The inner piston 190 moves back and forth in the axial direction 50 relative to the sealing ring 200, causing the third volume 198 to expand or contract, opening a fourth volume 210 disposed axially between the inner piston 190 and the body 150. At an axial end 212 of the inner piston 190, opposite the outer and inner seals 192, 194, is an outward tapered interior surface 214 (e.g., energizing taper portion, tapered annular or conical surface), which interfaces with an outward tapered exterior surface 216 (e.g., energizing taper portion, tapered annular or conical surface) of a lock ring 218 (e.g., annular lock ring). The lock ring 218 rests on a lip 220 (e.g., annular lip surface) of the outer sleeve 188. The outward tapered interior surface 214 interfaces with the outward tapered exterior surface 216 such that as the inner piston 190 moves downward in the axial direction 50, the lock ring 218 contracts radially inward from an unlocked position toward a loaded position relative to a lock ring groove 219 of the hanger. Correspondingly, when the inner piston 190 moves upward in the axial direction 50, the lock ring 218 expands radially outward from the loaded position toward the unlocked position relative to the lock ring groove 219 of the hanger 26. The outer sleeve 188 includes an interior seal 222 proximate an axial end 224 of the outer sleeve 188. When the hanger running tool 100 is coupled to the hanger 26, the interior seal 222 forms a seal between the outer sleeve 188 of the hanger running tool 100 and the hanger 26.

The hanger running tool 100 may include a push ring 226 coupled to the push members 186 disposed at, or proximate to, an axial end 228 of the hanger running tool 100. The push ring 226 may be configured to move back and forth in the axial direction 50 such that the push members 186 may move the push ring 226 by moving in the axial direction 50, thus actuating one or more components of the hanger 26.

Figure 3:
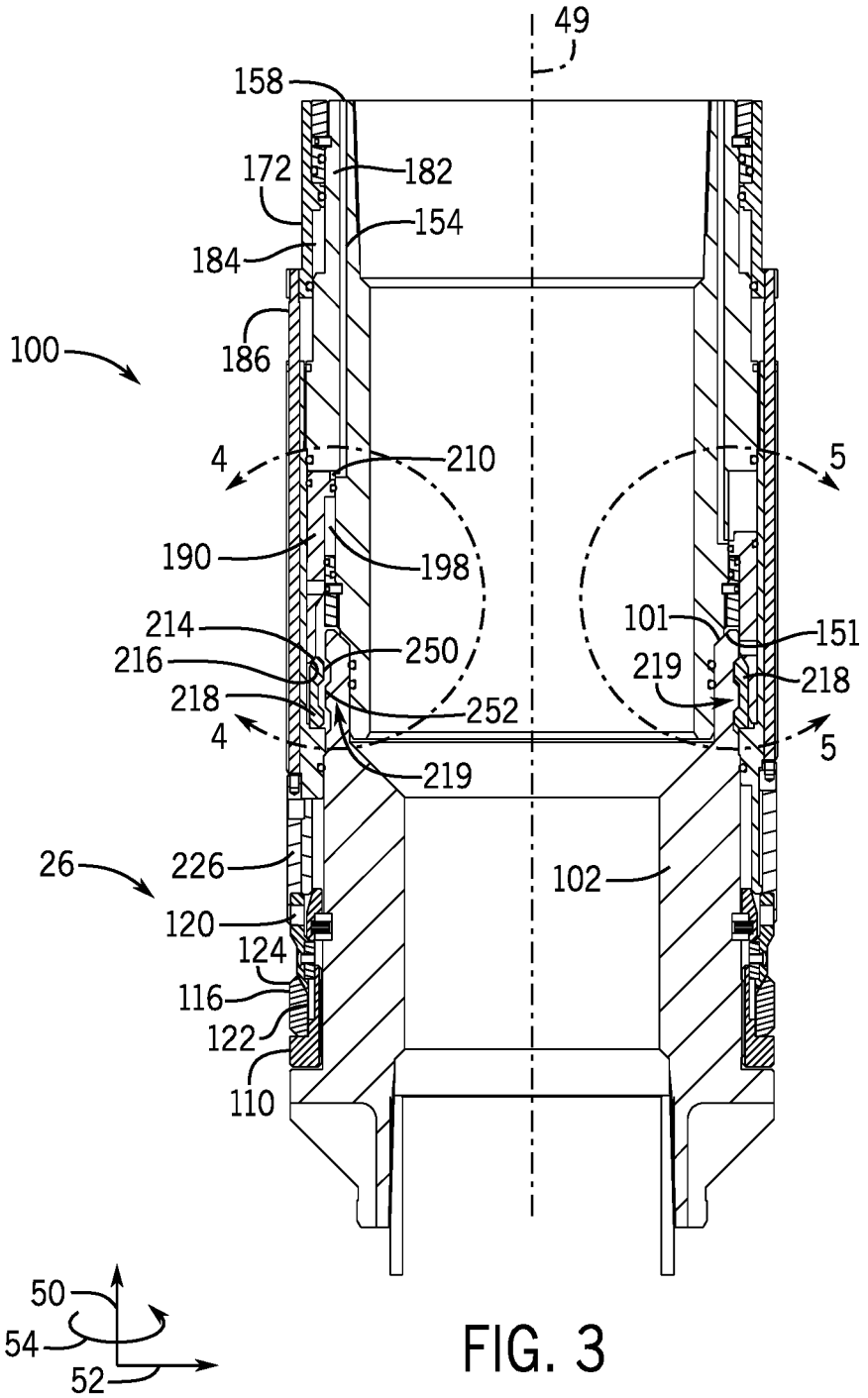
FIG. 3 is a side, section view of the hanger running tool disposed over and about the hanger such that a push ring of the hanger running tool lands on the hanger.

As shown in FIG. 2, the hanger running tool 100 may be coupled to the hanger 26 by moving the hanger running tool 100 over and around the hanger 26. FIG. 3 is a side, section view of the hanger running tool 100 disposed over and about the hanger 26 such that the body 150 of the hanger running tool 100 lands on the body 102 of the hanger 26. In particular, a tapered landing surface 151 of the body 150 lands on a tapered landing surface 101 of the body 102. The push ring 226 of the hanger running tool 100 and the push ring 120 of the hanger 26 may also contact one another. In some embodiments, the push ring 226 of the hanger running tool 100 and the push ring 120 of the hanger 26 may couple to one another (e.g., via one or more tabs and corresponding j-slots). It should be understood that the left side of FIG. 3 (i.e., left side of the axis 49) shows the lock ring 218 of the hanger running tool 100 decoupled from the body 102 of the hanger 26 (e.g., the lock ring 218 is expanded out of the groove 219), while the right side of FIG. 3 (i.e., right of the axis 49) shows the lock ring 218 of the hanger running tool 100 coupled to the body 102 of the hanger 26 (e.g., with the lock ring 218 compressed or retracted into the groove 219). In particular, once the hanger running tool 100 has landed on the hanger 26, a pressure (e.g., a hydraulic or pneumatic pressure) may be applied via the first pressure port 158 in order to couple the hanger running tool 100 to the hanger 26. Specifically, when a pressure is applied to the first passage 154 via the first pressure port 158, the fourth volume 210 is pressurized, pushing the inner piston 190 downward in the axial direction 50. As the inner piston 190 moves axially downward, the outward tapered interior surface 214 of the inner piston 190 interfaces with the outward tapered exterior surface 216 of the lock ring 218 to push the lock ring 218 radially inward against the body 102 of the hanger 26 from the unlocked position (i.e., left side of FIG. 3) to the locked position (i.e., right side of FIG. 3). As shown, an interior surface 250 of the lock ring 218 may have contours (e.g., teeth or ridges and grooves or recesses) that align with contours (e.g., teeth or ridges and grooves or recesses) in the groove 219 along an exterior surface 252 of the hanger body 102, such that when the lock ring 218 contracts in the radial direction 52, the hanger running tool 100 couples to the hanger 26. The surface 250 of the load ring 218 and the surface 252 of the groove 219 may include annular structures (e.g., teeth, ridges, grooves, or recesses) and/or circumferentially spaced structures. Once coupled together, the lock ring 218 in the groove 219 may block axial movement, radial movement, and/or circumferential movement between the tool 100 and the hanger 26. Coupling the hanger running tool 100 to the hanger 26 is shown and described in more detail with regard to FIGS. 4 and 5.

Figure 4:
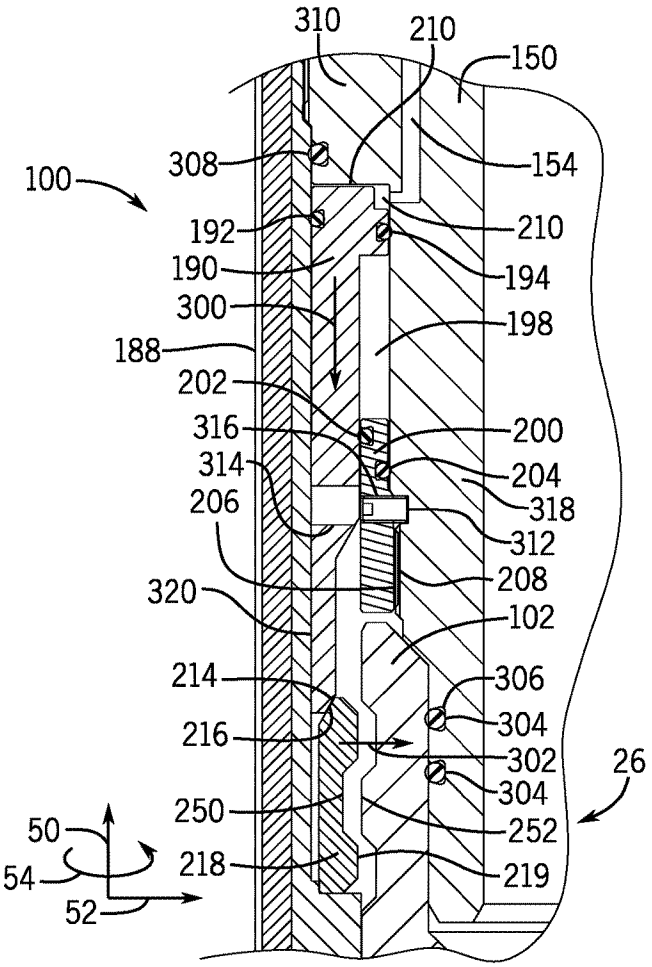
FIG. 4 is a side, section, detail view of the hanger running tool coupling to the hanger within line 4-4 of FIG. 3.

FIG. 4 is a side, section, detail view of the hanger running tool 100 coupling to the hanger 26 within line 4-4 of FIG. 3 illustrating the unlocked position of the load ring 218 expanded out of the groove 219. As discussed above, the first passage 154 is pressurized by applying a pressure to the first pressure port 158. As the pressure in the first passage 154 increases, the pressure in the fourth volume 210, which is in fluid communication with the first passage 154, also increases, pushing the inner piston 190 downward in the axial direction 50, indicated by arrow 300. As the inner piston 190 moves downward in the axial direction 50, the outward tapered interior surface 214 of the inner piston 190 interfaces with the outward tapered exterior surface 216 of the lock ring 218, contracting the lock ring 218 in the radial direction 52, indicated by arrow 302, until the interior surface 250 of the lock ring 218 contacts the exterior surface 252 of the groove 219 in the hanger 26 body 102.

As further illustrated in FIG. 4, the body 150 of the running tool 100 includes one or more seals 304 (e.g., o-rings) disposed in recesses 306 (e.g., annular grooves), such that the seals 304 create a seal between the body 150 of the tool 100 and the body 102 of the hanger 26. In addition, the body 150 of the tool 100 includes one or more seals 308 (e.g., o-rings) in respective recesses 310 (e.g., annular grooves), such that the seals 308 create a seal between the body 150 of the tool 100 and the outer sleeve 188. As discussed above, the sealing ring 200 is coupled to the body 150 of the tool 100 via engagement of threaded interior and exterior surfaces 206 and 208 (e.g., mating threads), while one or more lock members 312 (e.g., lock screws) blocks unthreading of the threads 206 and 208. The lock members 312 may be installed via one or more access openings 314 in the inner piston 190 and one or more openings 316 in the sealing ring 200, such that the lock members 312 extend radially through the sealing ring 200 and engage corresponding lock recesses 318 in the body 150 of the tool 100.

Figure 5:
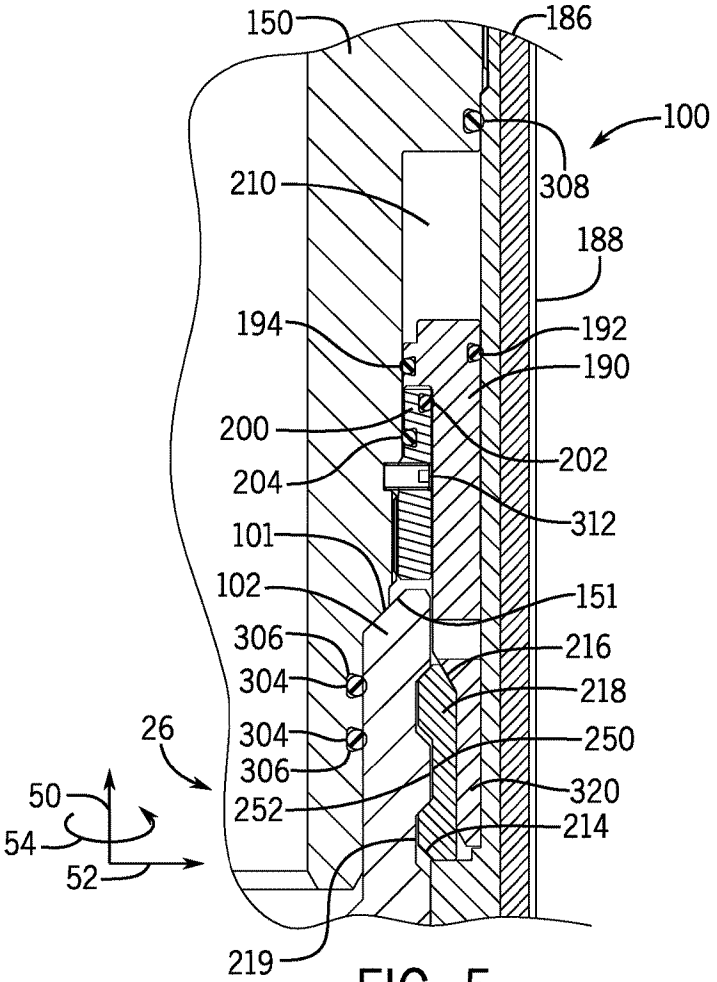
FIG. 5 is a side, section, detail view of the hanger running tool coupled to the hanger within line 5-5 of FIG. 3.

FIG. 5 is a side, section, detail view of the hanger running tool 100 coupled to the hanger 26 within line 5-5 of FIG. 3 illustrating the locked position of the load ring 218 contracted into the groove 219. As shown, the inner piston 190 has moved down such that it rests on the sealing ring 200, reducing the size of the third volume 198 and increasing the size of the fourth volume 210. Additionally, the interior surface 250 of the lock ring 218 is in contact with the exterior surface 252 of the groove 219 in the body 102, preventing relative axial movement between the hanger running tool 100 and the hanger 26. In the locked position, the inner piston 190 extends around and at least partially axially overlaps the lock ring 218, such that the inner piston 190 blocks expansion of the lock ring 218 radially out of the groove 219. In particular, a lower hold down portion 320 (e.g., annular hold down portion) of the inner piston 190 may extend concentrically about the lock ring 218 to hold the lock ring 218 within the groove 219, and thus hold the tool 100 in a locked position with the hanger 26.

Figure 6:
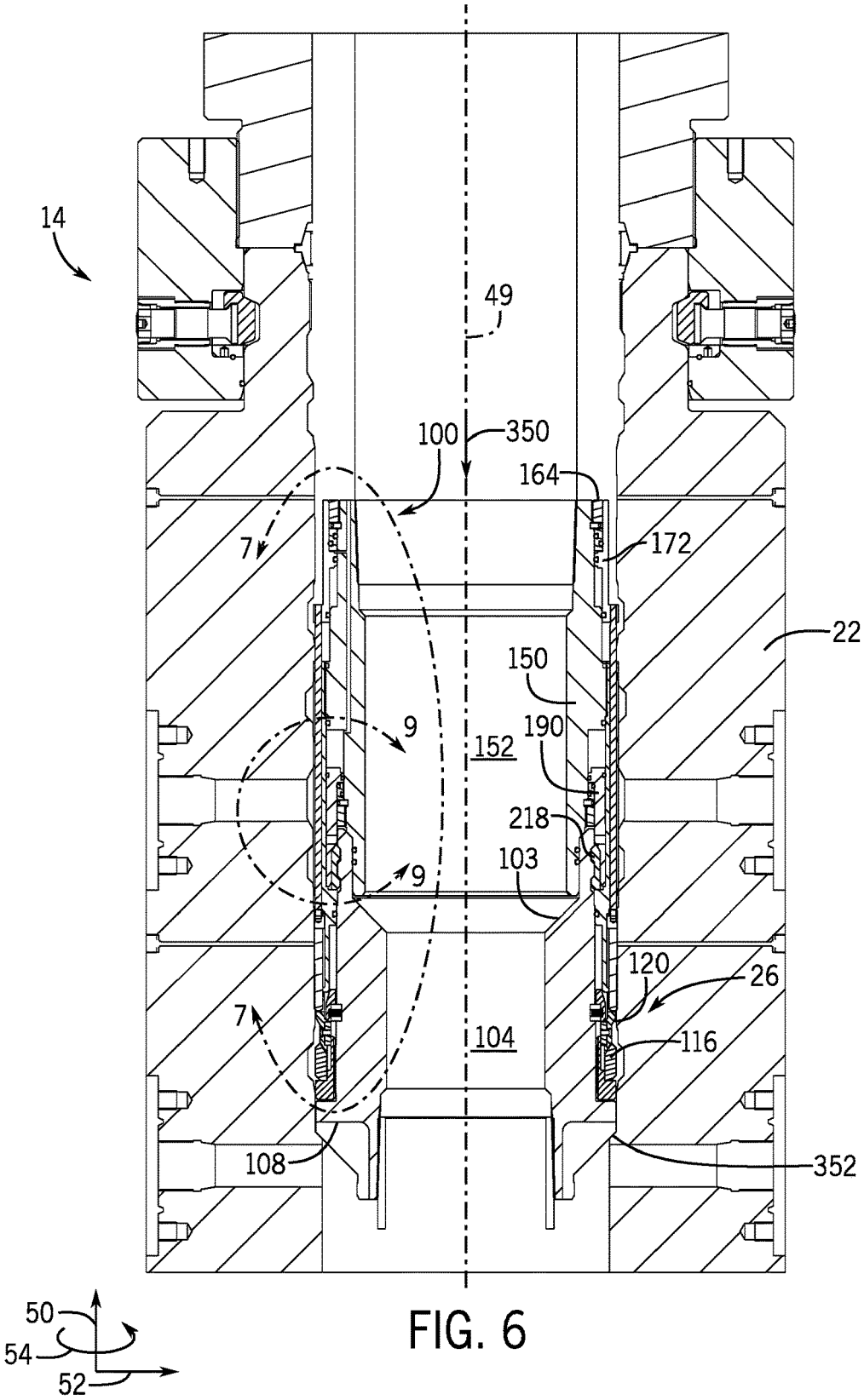
FIG. 6 is a side, section view of the hanger running tool and the hanger inserted into the wellhead assembly.

FIG. 6 is a side, section view of the hanger running tool 100 and hanger 26 inserted into a wellhead assembly 14. As shown, the hanger running tool 100 and hanger 26 are inserted into the well head assembly 14 in the axial direction 50, as indicated by arrow 350, until the lip 108 of the hanger 26 lands on a matching shoulder 352 (e.g., tapered annular landing shoulder) of the casing spool 22.

Figure 7:
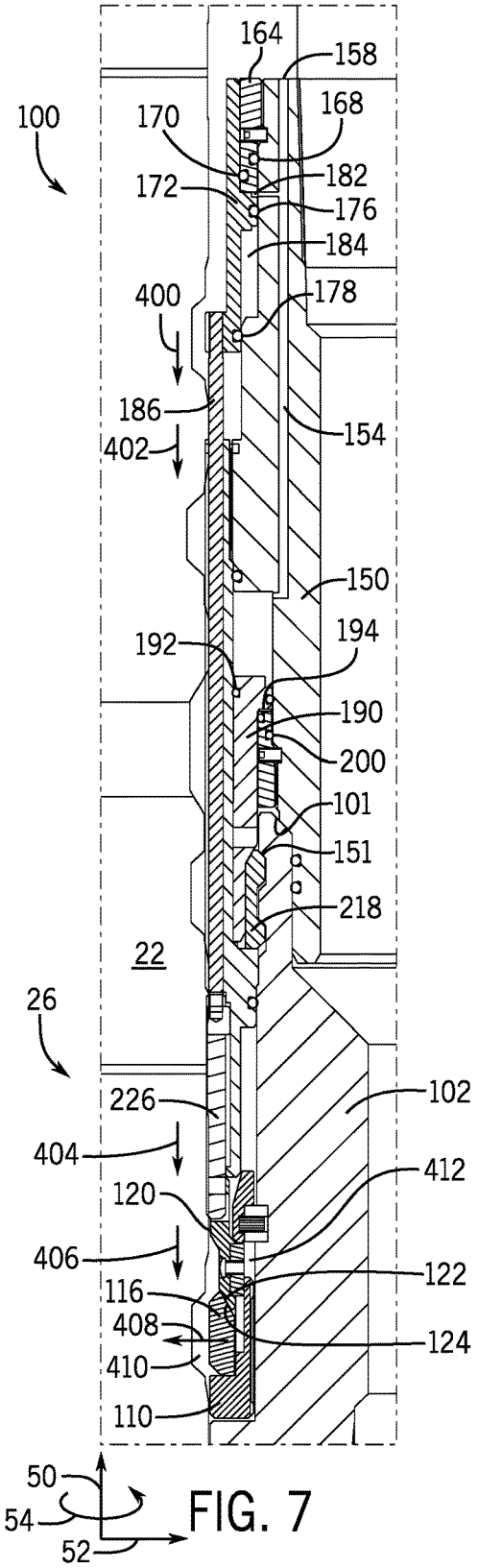
FIG. 7 is a side, section, detail view illustrating how a lock ring is actuated, taken within line 7-7 of FIG. 6.

Once the lip 108 of the hanger 26 has landed on the shoulder 352, the hanger 26 may be installed by actuating the lock ring 116. FIG. 7 is a side, section, detail view illustrating an unlocked position and actuation of the lock ring 116, taken within line 7-7 of FIG. 6. The first passage 154 is pressurized by applying a pressure (e.g., a hydraulic pressure or a pneumatic pressure) to the first pressure port 158. When the first passage 154 is pressurized, so is the first volume 182, which is in fluid communication with the first passage 154. The increased pressure in the first volume 182 pushes the outer piston 172 axially downward, as indicated by arrow 400. As the outer piston 172 moves axially downward, it pushes the push member 186 axially downward, as indicated by arrow 402. Correspondingly, the push member 186 pushes the push ring 226 of the hanger running tool 100 axially downward, indicated by arrow 404. The push ring 226 of the hanger running tool 100 pushes the push ring 120 of the hanger 26 axially downward, as indicated by arrow 406. As the push ring 120 of the hanger 26 moves axially downward, the inward tapered exterior surface 122 (e.g., energizing taper portion) of the push ring 120 interfaces with the inward tapered interior surface 124 (e.g., energizing taper portion) of the lock ring 116 to push the lock ring 116 radially outward, as indicated by arrow 408, into an annular recess 410 of the casing spool 22. When the lock ring 116 is disposed in the annular recess 410 of the casing spool 22, relative axial movement between the casing spool 22 and the hanger 26 is restricted.

Figure 8:
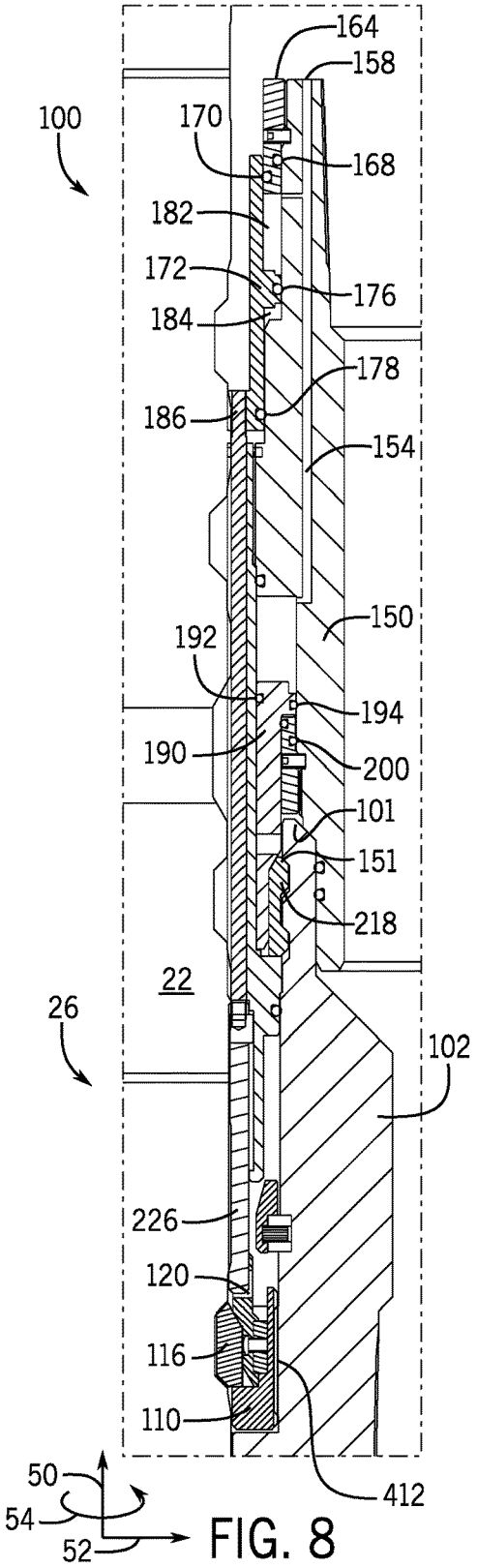
FIG. 8 is a side, section, detail view of the hanger engaged with the casing spool, taken within line 7-7 of FIG. 6.

FIG. 8 is a side, section, detail view of the hanger 26 engaged with the casing spool 22, taken within line 7-7 of FIG. 6 illustrating a locked position of the lock ring 116 in the recess 410. As illustrated, the outer piston 172 is at a low position, wherein the first volume 182 is large and the second volume 184 is small. Similarly, the push ring 120 of the hanger 26 is also in a low position, pushing the lock ring 116 radially outward into the annular recess 410 of the casing spool 22 such that relative axial movement between the casing spool 22 and the hanger 26 is restricted. In the locked position, the push ring 120 extends around and at least partially axially overlaps the lock ring 116, such that the push ring 120 blocks contraction of the lock ring 116 radially out of the annular recess 410. In particular, a lower hold down portion 412 (e.g., annular hold down portion) of the push ring 120 may extend concentrically about the lock ring 116 to hold the lock ring 116 within the annular recess 410, and thus hold the hanger 26 in a locked position with the casing spool 22.

Figure 9:
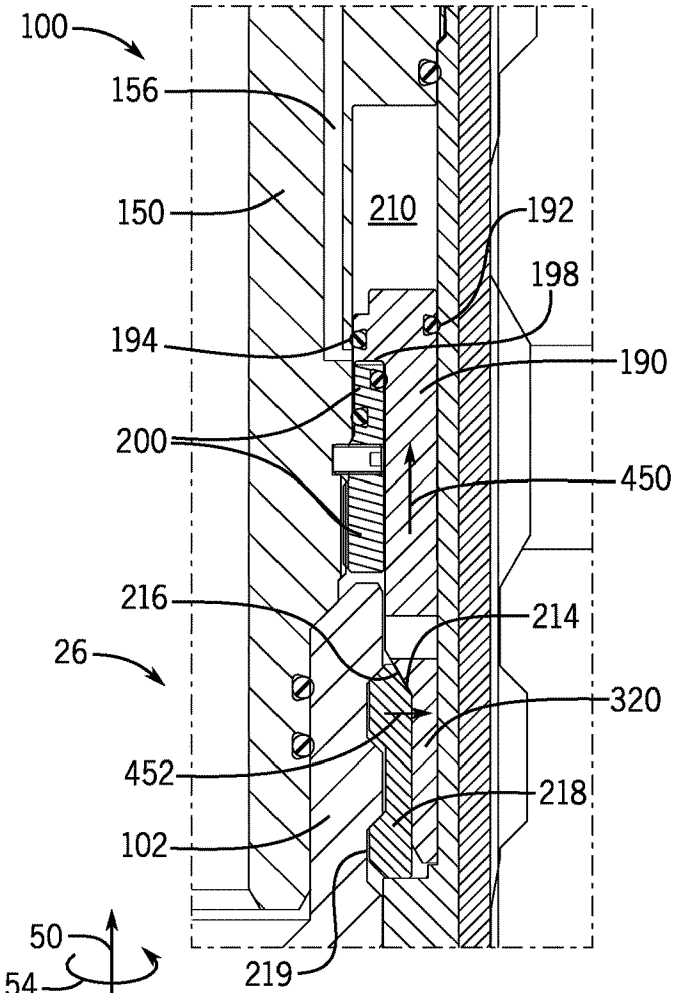
FIG. 9 is a side, section, detail view of illustrating the hanger running tool decoupling from the hanger, taken within line 9-9 of FIG. 6.

Once the hanger 26 has been coupled to the casing spool 22, the hanger running tool 100 may release the hanger 26. FIG. 9 is a side, section, detail view illustrating disengagement of a locked position of the hanger running tool 100 with the hanger 26, taken within line 9-9 of FIG. 6. To decouple the hanger running tool 100 from the hanger 26, a pressure (e.g., a hydraulic pressure or pneumatic pressure) may be applied to the second passage 156 (e.g., via the second pressure port 160). Applying a pressure to the second passage 156 also pressurizes the third volume 198, pushing the inner piston 190 axially upward, as indicated by arrow 450. As the inner piston 190 moves axially upward, the volume of space radially interior of the lock ring 218 is vacated, allowing the lock ring 218 to contract radially inward, as indicated by arrow 452. In particular, as the inner piston 190 moves axially upward, the lower hold down portion 320 (e.g., annular hold down portion) of the inner piston 190 moves axially away from the lock ring 218, such that the lower hold down portion 320 no longer axially overlaps and extends circumferentially around the lock ring 218 (e.g., creating an axial offset or gap therebetween). As a result, the lock ring 218 is able to automatically expand out of the groove 219, thereby releasing or unlocking the tool 100 from the hanger 26 as illustrated in FIG. 10.

Figure 10:
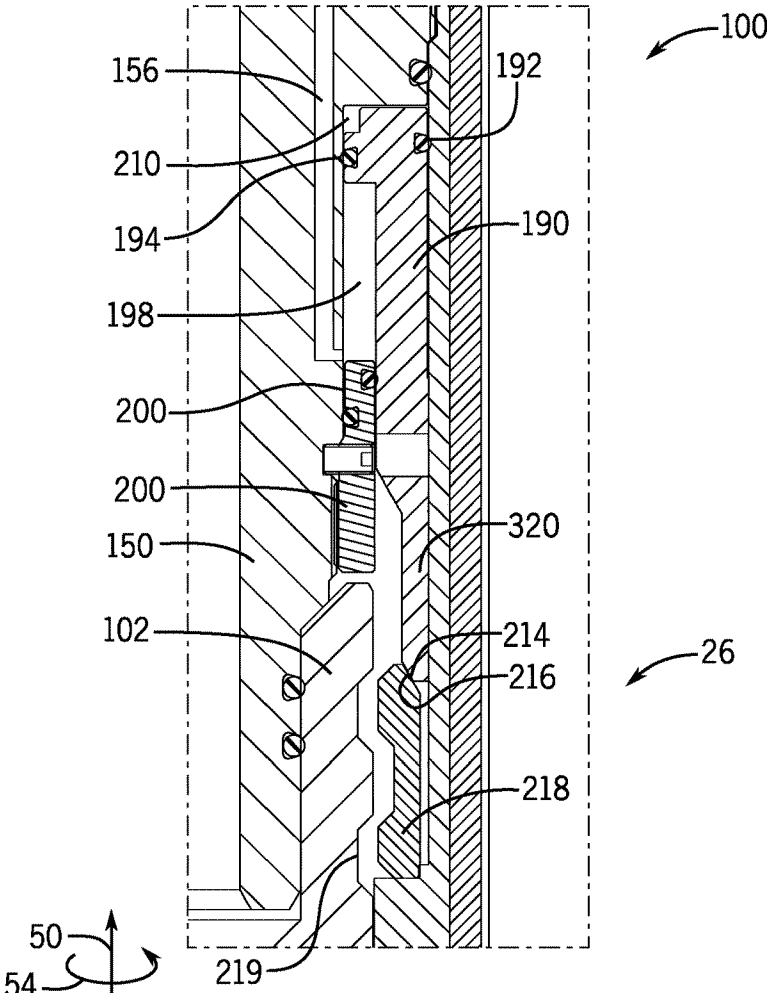
FIG. 10 is a side, section, detail view of the hanger running tool decoupled from the hanger, taken within line 9-9 of FIG. 6.

FIG. 10 is a side, section, detail view of the hanger running tool 100 decoupled from the hanger 26 (i.e., unlocked position), taken within line 9-9 of FIG. 6. As illustrated, the inner piston 190 is in an elevated position, such that the fourth volume 210 is small and the third volume 198 is large. Additionally, the lock ring 218 is retracted from the recess 219 in the body 102 of the hanger 26. In the illustrated unlocked position, the lower hold down portion 320 of the inner piston 190 is generally above the lock ring 218, although the surfaces 214 and 216 may or may not still be in contact with one another (i.e., there may be some insubstantial overlap via surfaces 214 and 216). However, the lower hold down portion 320 is no longer in a blocking position relative to the lock ring 218, such that the lock ring 218 is released and free to expand automatically (e.g. via spring force in the lock ring 218) from the locked position (FIG. 9) to the unlocked position (FIG. 10). In this unlocked position, the hanger running tool 100 may be retrieved from the wellhead assembly 14, while the hanger 26 remains locked in position with the casing spool 22.

Figure 11:
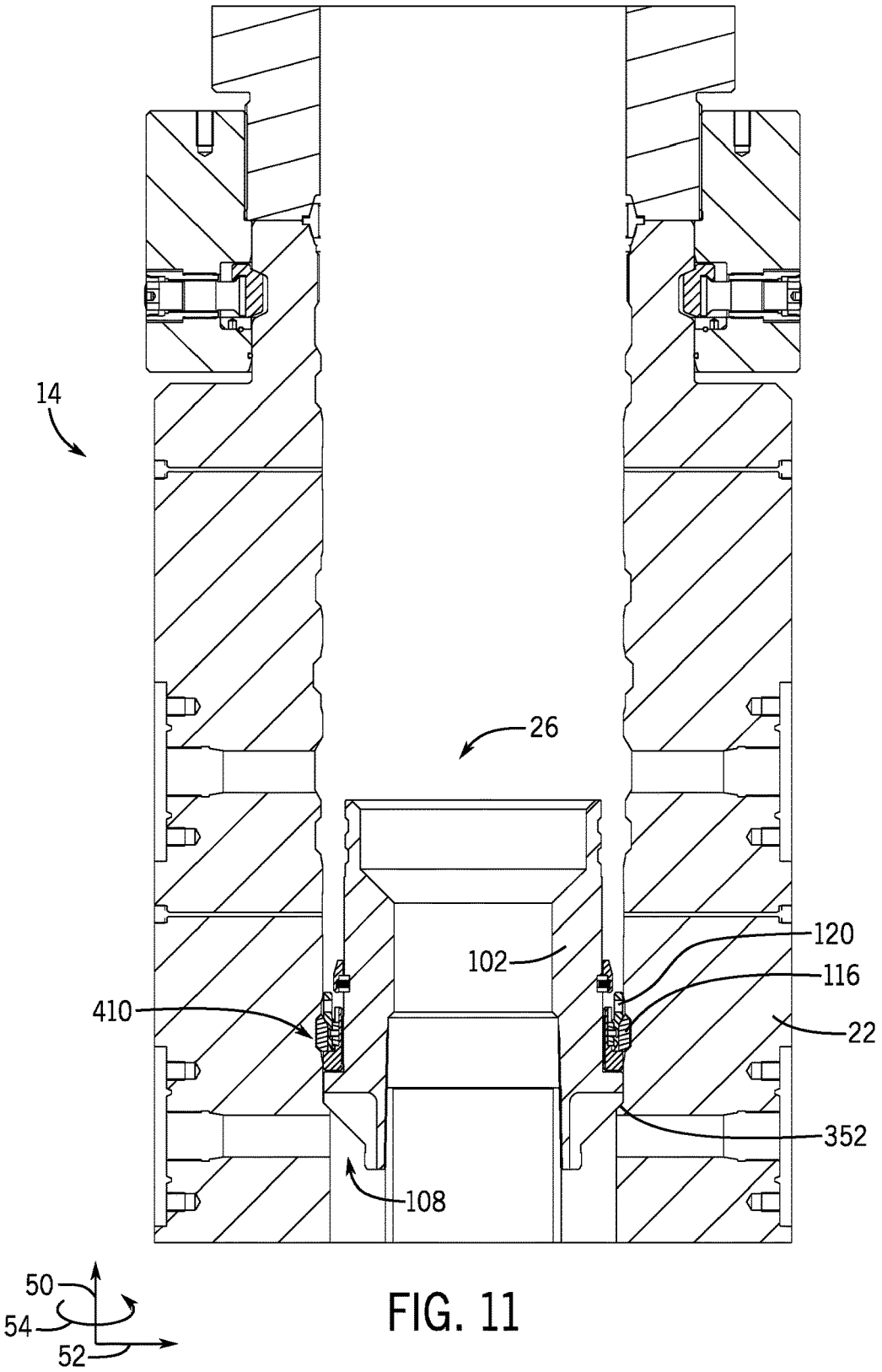
FIG. 11 is a side, section view of the hanger installed within the wellhead assembly, with the hanger running tool removed.

FIG. 11 is a side, section view of the hanger 26 installed within the wellhead assembly 14, with the hanger running tool 100 removed. As illustrated, the lip 108 of the hanger 26 rests on the shoulder 352 of the casing spool 22. However, it should be understood that FIG. 11 illustrates one exemplary embodiment and that the hanger 26 may be installed within other components of the wellhead assembly 14 (e.g., the tubing spool 24, the casing spool 22, housing, etc.). In the installed configuration of the hanger 26, the push ring 120 is in a low position, with the lower hold down portion 412 pushing and holding the lock ring 116 radially outward into the recess 410 of the casing spool 22, thus restricting relative axial movement between the hanger 26 and the casing spool 22.

The presently disclosed embodiments include a hydraulically actuated hanger 26 and hanger running tool 100 capable of installing a hanger in a wellhead assembly 14 in a single trip. Installing a hanger 26 in a single trip, using hydraulics, reduces the time and cost associated setting up and operating a mineral extraction system. In the disclosed embodiments, a plurality of pistons (e.g., outer piston 172 and inner piston 190) are sequentially actuated via a pressurized fluid to actuate the lock ring 218 to secure the running tool 100 to the hanger 26, and also to actuate the lock ring 116 to secure the hanger 26 to the casing spool 22. In particular, the piston driven actuation of the lock rings 218 and 116 may be achieved using a single first direction of axial motion of the pistons 172 and 190, although certain embodiments may drive actuation of the lock rings 218 and 116 using opposite first and second directions of axial motion of the pistons 172 and 190. Furthermore, the piston drive actuation of the lock rings 218 and 116 may be achieved using a common fluid passage (e.g., 154). Subsequently, the running tool 100 may be released from the hanger 26 by actuating the inner piston 190 via a pressurized fluid (e.g., via fluid passage 156) to release the lock ring 218 between the running tool 100 and the hanger 26, while the lock ring 116 is still held in place to secure the hanger 26 to the casing spool 22. The running tool 100 may then be retrieved from the wellhead assembly 14. Alternatively, if hanger 26 removal is desired, then the running tool 100 may be coupled to the hanger 26 by actuating the inner piston 190 via a pressurized fluid (e.g., via fluid passage 154) to lock the lock ring 218 between the running tool 100 and the hanger 26, followed by release of the hanger 26 from the spool 22 by actuating the outer piston 172 via a pressurized fluid (e.g., via fluid passage 156) to release the lock ring 116 between the hanger 26 and the casing spool 22. The running tool 100 with attached hanger 26 may then be retrieved from the wellhead assembly 14.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a hanger running tool, comprising:

a tool body;

a first piston configured to move a first lock member between first locked and unlocked positions between the tool body and a hanger;

a second piston configured to move a second lock member between second locked and unlocked positions between the hanger and a tubing;

an outer sleeve disposed about the tool body, the first piston, and the second piston; and one or more push members coupled to the second piston and extending from the second piston to the hanger interior of the outer sleeve.

2. The system of claim 1, wherein the first and second pistons are fluid driven pistons.

3. The system of claim 2, comprising a first common fluid passage configured to supply fluid to drive the first piston from the first unlocked position to the first locked position and to drive the second piston from the second unlocked position to the second locked position.

4. The system of claim 3, comprising a second common fluid passage configured to supply fluid to drive the first piston from the first locked position to the first unlocked position and to drive the second piston from the second locked position to the second unlocked position.

5. The system of claim 1, wherein the first and second pistons are configured to move in a first common axial direction to move from the respective first and second unlocked positions to the respective first and second locked positions, and the first and second pistons are configured to move in a second common axial direction to move from the respective first and second locked positions to the respective first and second unlocked positions.

6. The system of claim 1, wherein the first and second pistons extend circumferentially about an axis of the tool body.

7. The system of claim 1, wherein the first and second lock members comprise respective first and second lock rings.

8. The system of claim 1, wherein the first piston is configured to drive the first lock member in a first radial direction from the first unlocked position toward the first locked position between the tool body and the hanger.

9. The system of claim 8, wherein the first radial direction is a radial inward direction.

10. The system of claim 8, wherein the second piston is configured to drive the second lock member in a second radial direction from the second unlocked position toward the second locked position between the hanger and the tubing.

11. The system of claim 10, wherein the first and second radial directions are opposite from one another.

12. The system of claim 1, wherein the hanger running tool is configured to run and lock the hanger into the tubing in a single trip.

13. The system of claim 1, comprising the hanger, wherein the first lock member is coupled to the tool body of the hanger running tool, and the second lock member is coupled to a hanger body of the hanger.

14. The system of claim 1, comprising the tubing, wherein the tubing comprises a wellhead assembly.

15. A method, comprising:

driving a first piston of a hanger running tool to move a first lock member coupled to a tool body between first locked and unlocked positions relative to a hanger; and driving a second piston of the hanger running tool to move a second lock member coupled to the tool body, via one or more push members, between second locked and unlocked positions relative to a tubing, wherein the one or more push members are coupled to the second piston and extend from the second piston to the hanger interior of an outer sleeve disposed about the tool body, the first piston, and the second piston.

16. The method of claim 15, comprising supplying fluid to drive the first and second pistons.

17. The method of claim 15, comprising running and locking the hanger to the tubing in a single trip via the hanger running tool.

18. A system, comprising:

a hanger, comprising:

a hanger body;

a first lock portion configured to couple the hanger body with a hanger running tool via a first piston configured to move a first lock member between first locked and unlocked positions; and a second lock portion configured to couple the hanger body with a tubing via a second piston configured to move a second lock member between second locked and unlocked positions via one or more push members, wherein the one or more push members are coupled to the second piston and extend from the second piston to the hanger interior of an outer sleeve disposed about the tool body, the first piston, and the second piston.

19. The system of claim 18, wherein the hanger comprises the second lock member and a push ring coupled to the hanger body, and the first lock portion comprises a first lock recess in the hanger body and configured to engage with the first lock member.

20. The system of claim 18, comprising the hanger running tool having a tool body, the first and second pistons coupled to the tool body, and the first lock member coupled to the tool body.

* * * * *